US007905238B2

(12) United States Patent
Moon

(10) Patent No.: US 7,905,238 B2
(45) Date of Patent: Mar. 15, 2011

(54) DRAWER-LIKE COSMETIC CASE

(75) Inventor: Hyun-Myung Moon, Yongin (KR)

(73) Assignee: Interwork Korea Co., Ltd, Seoul (KR)

( * ) Notice: Subject to any disclaimer, the term of this patent is extended or adjusted under 35 U.S.C. 154(b) by 730 days.

(21) Appl. No.: 11/977,552

(22) Filed: Oct. 25, 2007

(65) Prior Publication Data

US 2008/0265731 A1 Oct. 30, 2008

(30) Foreign Application Priority Data

Mar. 12, 2007 (KR) ..... 20-2007-0004031 U
May 8, 2007 (KR) ..... 20-2007-0007552 U

(51) Int. Cl.
*A45D 33/20* (2006.01)

(52) U.S. Cl. ..... 132/287

(58) Field of Classification Search ..... 132/287, 132/293–303; 206/823, 581
See application file for complete search history.

(56) References Cited

U.S. PATENT DOCUMENTS

| | | | | | |
|---|---|---|---|---|---|
| 1,493,657 | A * | 5/1924 | Wacker et al. | ..... | 132/287 |
| 1,525,665 | A * | 2/1925 | Slover et al. | ..... | 132/287 |
| 1,573,393 | A * | 2/1926 | Gold et al. | ..... | 132/287 |
| 1,895,061 | A * | 1/1933 | Worssam | ..... | 132/287 |
| 2,416,029 | A * | 2/1947 | Turnes | ..... | 132/320 |
| 3,586,010 | A * | 6/1971 | Landen et al. | ..... | 132/287 |
| 6,889,696 | B2 * | 5/2005 | Thorpe et al. | ..... | 132/287 |

* cited by examiner

*Primary Examiner* — Robyn Doan
(74) *Attorney, Agent, or Firm* — Gifford, Krass, Sprinkle, Anderson & Citkowski, P.C.

(57) ABSTRACT

A cosmetic case includes an outer case and a drawer-like inner case drawn in or drawn out the outer case, the drawer-like inner case having a space for accommodating cosmetics wherein the outer case has a push-pull locking device therein and the drawer-like inner case has a hooking member outside thereof such that the push-pull locking device is cooperated with the hooking member and the outer case further has a spring therein such that the spring presses the drawer-like inner case in a drawn-out direction, the cosmetic case allows the drawer-like inner case to be automatically drawn in and out the outer case by means of an operation of the push-pull locking device when the user lightly pushes the drawer-like inner case in a drawn-in direction. Thus, it is convenient to carry the cosmetic case and it is prevented from a leakage of the contents.

7 Claims, 8 Drawing Sheets

DRAWER-LIKE COSMETIC CASE

CROSS-REFERENCE TO RELATED APPLICATION

This application claims priority to and the benefit of Korean Patent Application No. 20-2007-0007552 & 20-2007-0004031 filed in the Korean Intellectual Property Office on Mar. 12, 2007 & May 8, the entire contents of which are incorporated herein by reference.

BACKGROUND OF THE INVENTION (a) Field of the Invention

The present invention relates to a drawer-like cosmetic case which puts cosmetic contents such as powder, foundation, and cake in a drawer-like inner case thereof. More particularly, the present invention relates to a drawer-like cosmetic case which can be automatically opened and closed by means of pushing a front portion of the drawer-like inner case.

(b) Description of the Related Art

A compact folder has been widely used as a cosmetic case for putting in powder, foundation, and cake or the like. Generally, the compact folder includes a case and a lid hinged to the case, and accordingly, the case may be opened and closed when the lid is opened and closed. The lid may have a mirror mounted inside thereof and the case may have a few separately divided spaces which respectively put at least one cosmetic contents and a puff therein.

However, it is inconvenient to carry such a compact folder because it may leak cosmetic contents though a clearance of between the case and the lid. In addition, the leaked cosmetic contents may contaminate the mirror which is mounted inside of the lid, and accordingly, the compact folder may be easily contaminated.

Accordingly, a drawer-like cosmetic case has been proposed so as to carry the same without leaking the cosmetic contents.

However, it is inconvenient to draw in and out the drawer-like cosmetic case. And also, the drawer-like cosmetic case may be easily opened of itself when it is carried, and accordingly, the drawer-like cosmetic case must have a locking device not to leak cosmetic contents.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a drawer-like cosmetic case having advantages of being automatically closed and opened by means of lightly pushing the drawer-like inner case in a drawn-in direction.

The present invention has been made in an effort to provide a drawer-like cosmetic case having advantages of being convenient to carry the same and prevented from a leakage of the contents.

An exemplary embodiment of the present invention provides a drawer-like cosmetic case including an outer case and a drawer-like inner case drawn in or drawn out the outer case, the drawer-like inner case having at least one space for putting cosmetic contents wherein the outer case has a push-pull locking device and a pair of springs for pressing the drawer-like inner case in a drawn-out direction therein and the drawer-like inner case has a hooking member outside thereof such that the hooking member is cooperated with the push-pull locking device.

BRIEF DESCRIPTION OF THE DRAWINGS

FIG. 3 is a schematic side view taken longitudinally along a push-pull locking device of a cosmetic case according to an exemplary embodiment of the present invention, when a drawer-like inner case is drawn in.

DETAILED DESCRIPTION OF THE EMBODIMENTS

Hereinafter, a preferred embodiment of the present invention will be described in detail with reference to the accompanying drawings.

Figure 1:
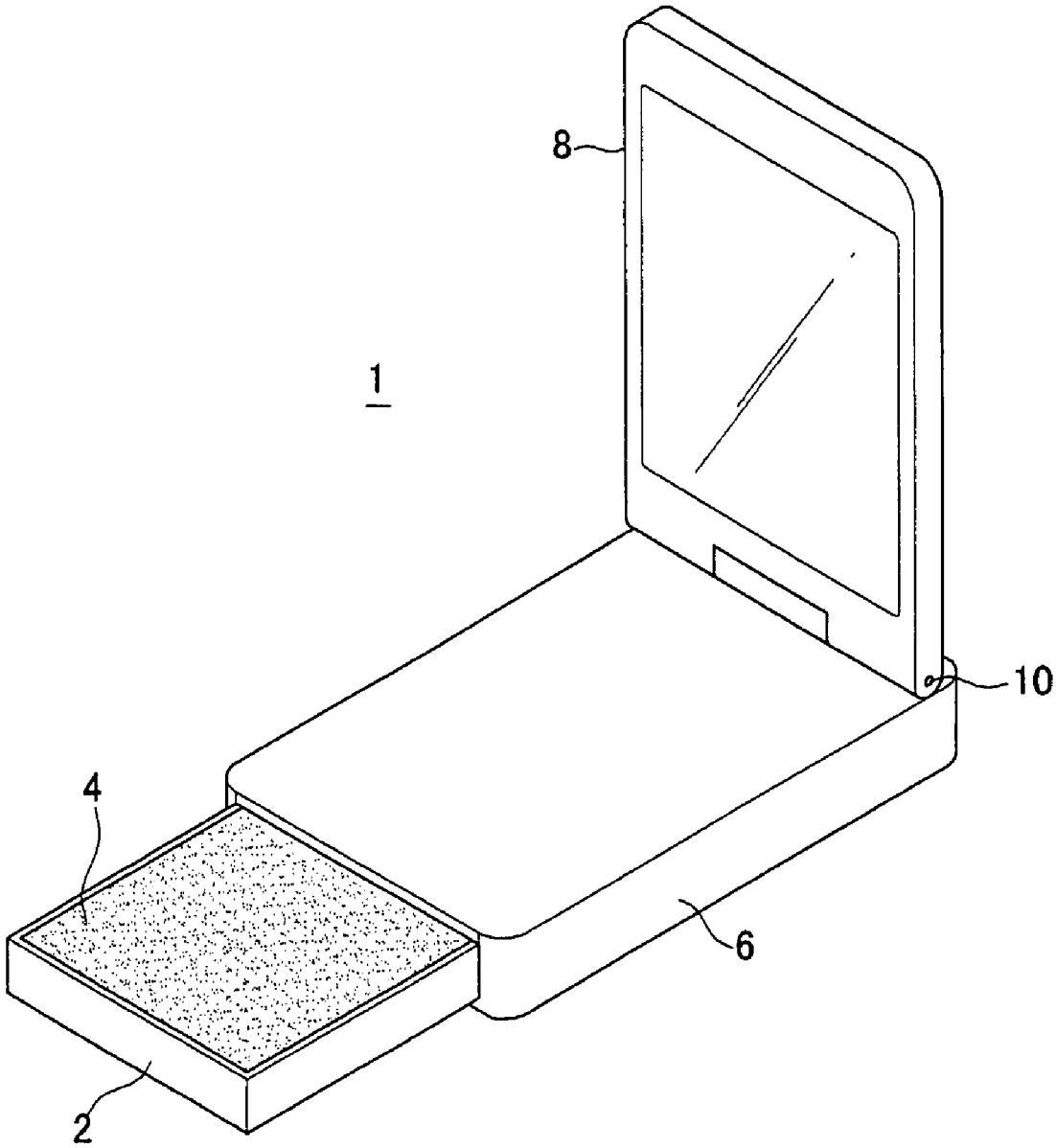
FIG. 1 is a perspective view of a drawer-like cosmetic case according to an exemplary embodiment of the present invention.
Figure 2:
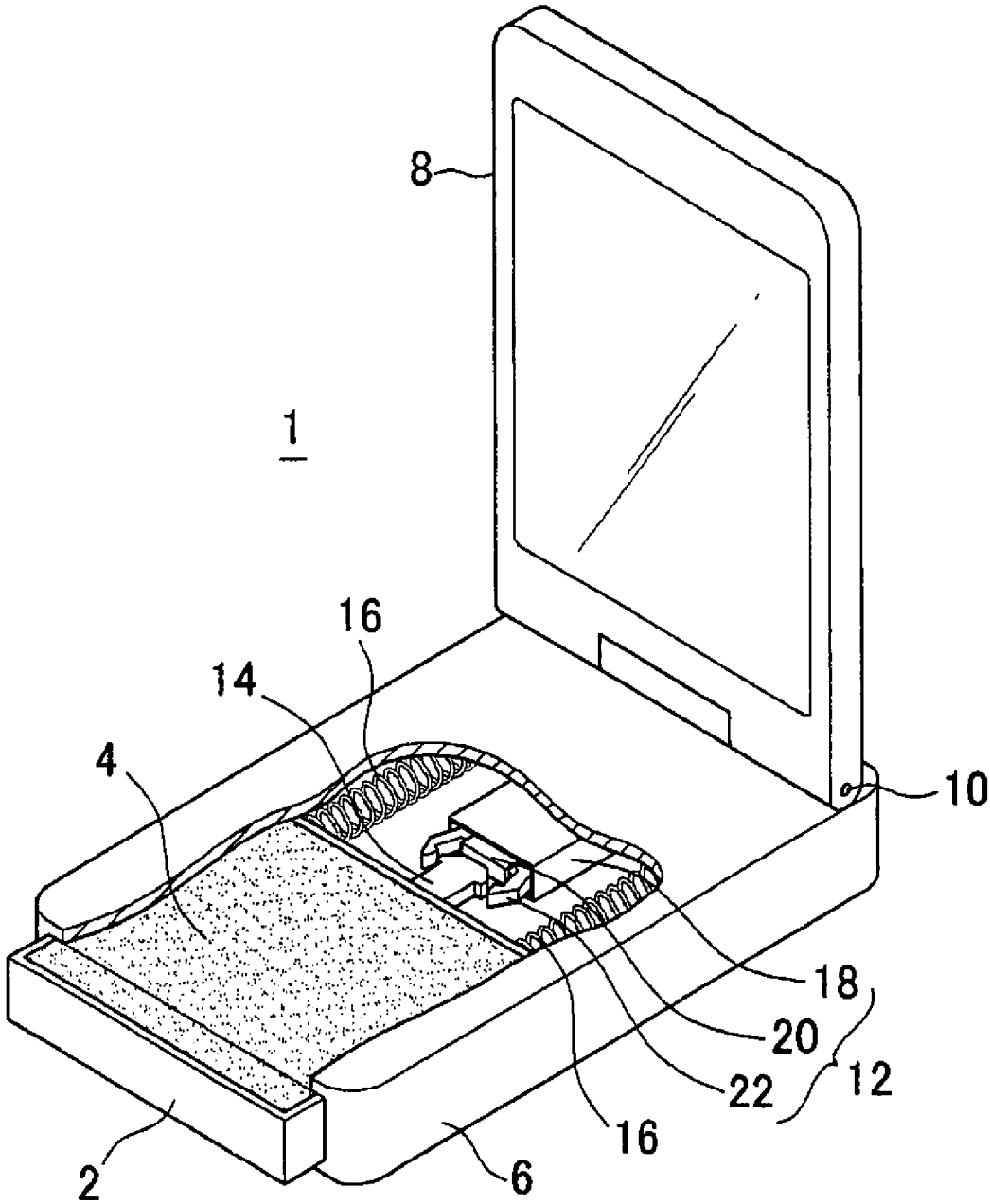
FIG. 2 is a perspective view of a drawer-like cosmetic case in which an upper part of a drawer-like cosmetic case of FIG. 1 is partly cut so as to show an internal structure thereof.

FIG. 1 is a perspective view of a drawer-like cosmetic case according to an exemplary embodiment of the present invention and FIG. 2 is a perspective view of a drawer-like cosmetic case in which an upper part of a drawer-like cosmetic case of FIG. 1 is partly cut so as to show an internal structure thereof. As shown in FIG. 1, a drawer-like cosmetic case 1 includes a drawer-like inner case 2 having a space 4 inside thereof, an outer case 6 selectively covering the drawer-like inner case 2, a mirror supporting plate 10 to be folded on the outer case 6 by a hinged shaft 10. The mirror supporting plate 8 has a mirror 8*a* mounted inside thereof. The outer case 6 has an opening portion 6*a* at a front portion thereof such that the drawer-like inner case 2 may be drawn in and out, As shown in FIG. 2, the outer case 6 has a push-pull locking device 12 disposed therein and the drawer-like inner case 2 has a hooking member 14 integrally mounted on a rear portion thereof. Accordingly, the hooking member 14 is connected with the push-pull locking device 12 when the drawer-like inner case 2 is drawn in the outer case 6. In addition, the outer case 6 may further include a pair of springs 16 disposed at both sides of the push-pull locking device 12. The pair of springs 16 functions to elastically press the drawer-like inner case 2 in a drawn-out direction (X-axis direction of FIG. 2) of the drawer-like inner case 2. The pair of springs 16 may have one end 16*a* fixed at the rear portion of the drawer-like inner case 2 and the other end 16*b* fixed at the rear portion of the outer case 6.

The push-pull locking device 12 includes a guide member 18, a sliding member 20, and a pair of gripping members 22. The guide member 18 is found in a box projected from a rear portion thereof in the outer case 6 and has an opening portion

20*a* in a front portion thereof. The sliding member 20 moves through the opening portion 20*a* along a longitudinal direction in the guide member 18. The pair of gripping members 22 is elastically mounted on both sides of the front portion of the sliding member 20. The pair of gripping members 22 grips the hooking member 14 of the drawer-like inner case when the drawer-like inner case is drawn in the outer case 6. The gripping members 22 are in contact with the inside portions of the guide member 18 when the drawer-like inner case is drawn out the outer case 6.

The sliding member 20 may have one pair of springs 24 respectively disposed at both sides thereof and one pair of stopping sheets 202 respectively disposed at both sides thereof. The pair of stopping sheets 202 defines the movement of the pair of springs 24.

Figure 3:
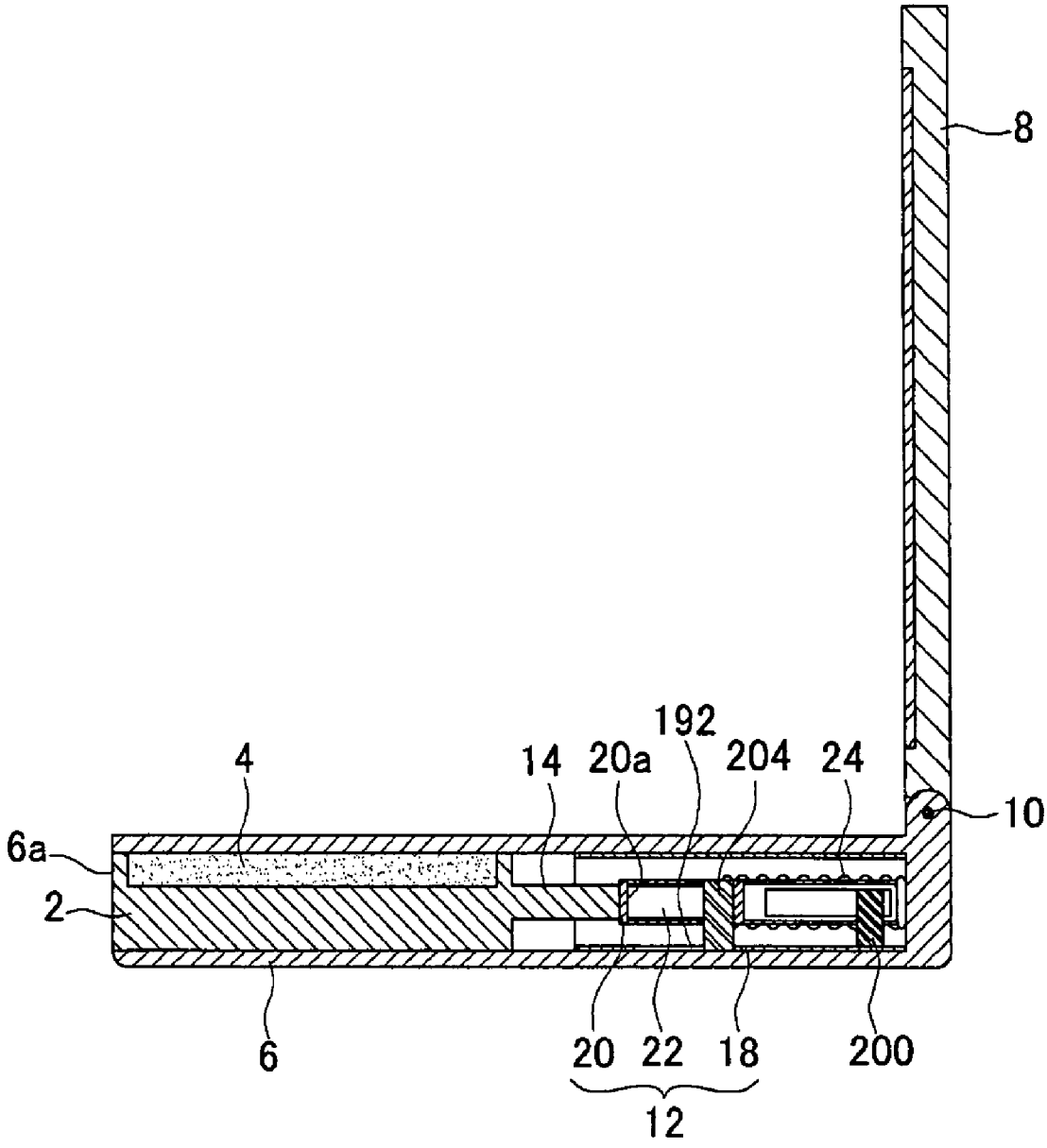
Figure 4A:
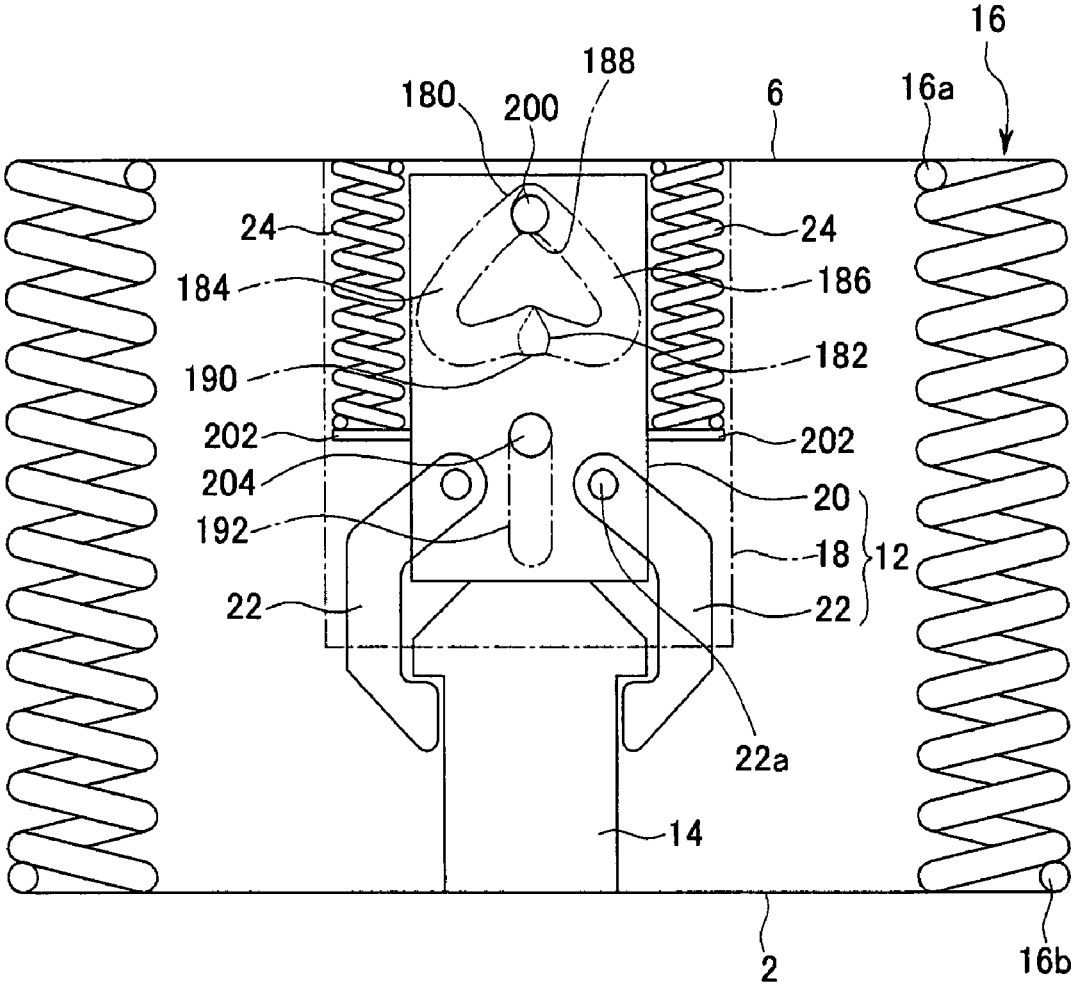
FIG. 4A and FIG. 4B respectively schematically illustrates a push-pull locking mechanism of a drawer-like cosmetic case according to an exemplary embodiment of the present invention, when a drawer-like case is drawn in or out.
Figure 4B:
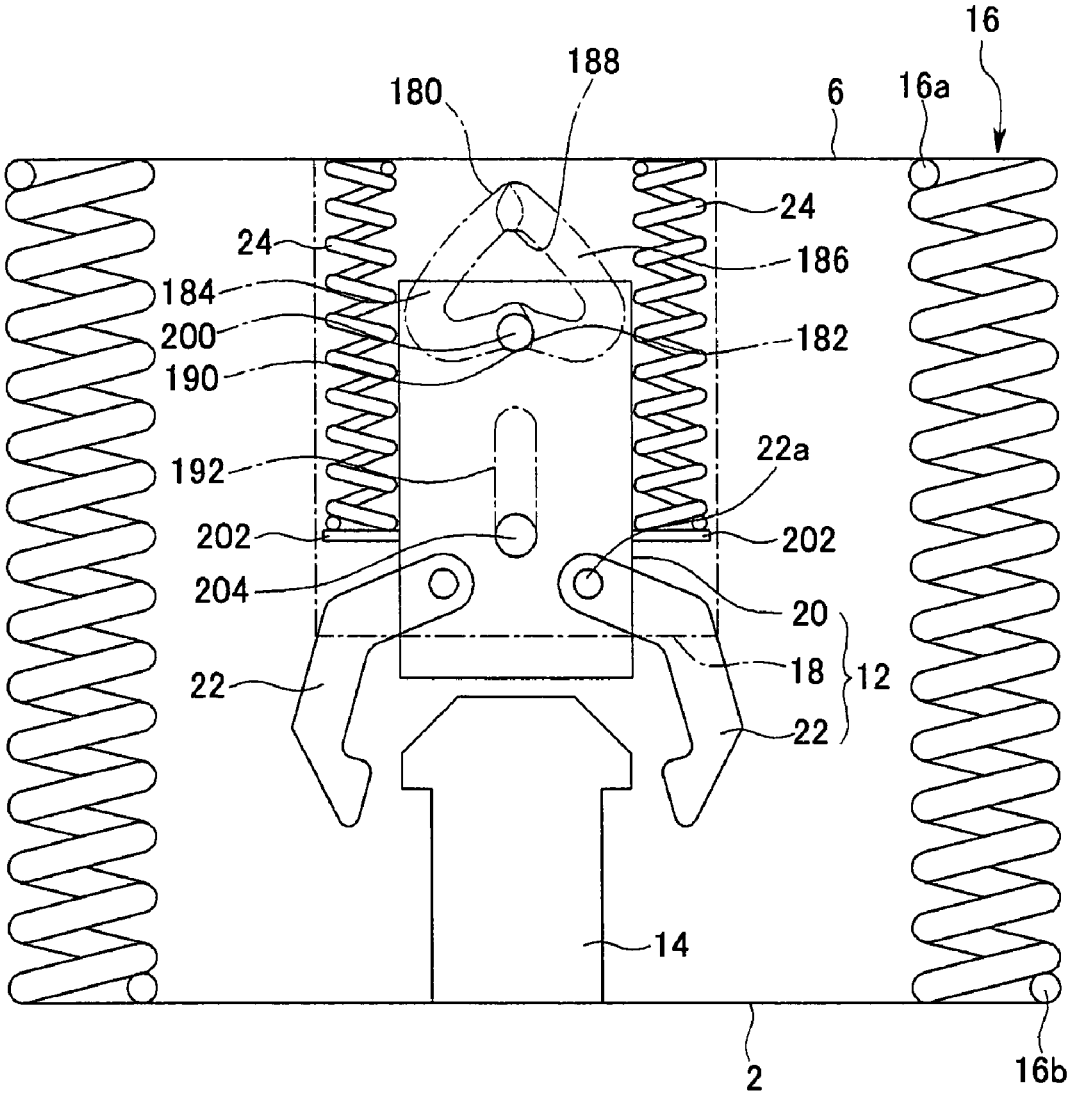

FIG. 3 is a schematic side view taken longitudinally along a push-pull locking device of a cosmetic case according to an exemplary embodiment of the present invention, when a drawer-like inner case is drawn in. FIG. 4A and FIG. 4B respectively schematically illustrates a push-pull locking mechanism of a drawer-like cosmetic case according to an exemplary embodiment of the present invention, when a drawer-like case is drawn in or out.

The guide member 18 has a drawn-in path 184 and a drawn-out path 186 connected each other on the bottom surface thereof such that a triggering pin 200 is circulated only in one direction along the drawn-in path 184 and the drawn-out path 186, in which the triggering pin 200 is formed downward from the bottom surface of the sliding member 20. The drawn-in path 184 and the drawn-out path 186 respectively have a drawn-in groove 188 and a drawn-out groove 190 and a one-directional inside projection 180 and one-directional outside projection 182.

The sliding member 20 may further include a guide pin 204 formed before the triggering pin 200 downward from the bottom surface thereof. The guide pin 204 may move straightly in a guide slot 192 of the guide member 18 such that the sliding member 20 may not be separated from the guide member 18. Accordingly, when the pair of springs 24 elastically presses the stopping sheet 202 in a drawn-out direction of the drawer-like inner case 2, the sliding member 20 may move straightly.

In addition, the triggering pin 200 may be moved in one single direction by the one-directional inside projection 180. In FIG. 4A and FIG. 4B, the triggering pin 200 is circulated in a clockwise direction from the drawn-in path 184 to the drawn-out path 186.

The pair of gripping members 22 is rotationally fixed on the sliding member 20 and may be disposed such that it may be in contact with the inside of the guide member 18 when the hooking member 14 is drawn out. Accordingly, when the triggering pin 200 of the sliding member 20 is passed though the drawn-in path 184 and then is disposed in the drawn-in groove 188 continued with the inside one-directional projection 180, that is, the drawer-like inner case 2 is drawn in the outer case 6, the pair of gripping member 22 make narrower to grip the hooking member 14.

Thus, although the elastic force of the both springs 16 pushes the drawer-like inner case 2 outwardly, the drawer-like inner case 2 may be maintained in the outer case 6.

And then, a user pushes the front portion of the drawer-like inner case 2 so that an end portion of the hooking member 14 pushes the sliding member 20 in the guide member 18 and the triggering pin 200 is deviating from the drawn-in groove 188 and shifted on the drawn-out path 184.

At this time, the elastic force of the spring 24 allows the sliding member 20 to be drawn out in which the guide pin 204 is introduced outward along the guide slot 192 as shown in FIG. 4B and the gripping member 22 is gone out of in the guide member 18, and simultaneously, the drawer-like inner case 2 is impelled.

As a result, the drawer-like inner case 2 is automatically drawn out from the outer case 6, the triggering pin 200 of the sliding member 20 is passed through the drawn-out path 186, gone beyond the outside one-directional projection 182, and shifted into the drawn-out groove 190.

In addition, if the user pushes the front portion of the drawer-like inner case 2 into the opening portion 6*a* of the outer case 6 when the drawer-like inner case is drawn in as shown in FIG. 4B, the hooking member 14 pushes the sliding member 20 and accordingly the gripping member 22 are shriveled into the guide member 18 and closed to grip the hooking member 14. At this time, the triggering pin 200 of the sliding member 20 goes out of the drawn-out groove 190 and is introduced on the drawn-in path 184, goes beyond the inside one-directional projection 180, is maintained in the drawn-in groove 188, as shown in FIG. 4A.

Figure 5:
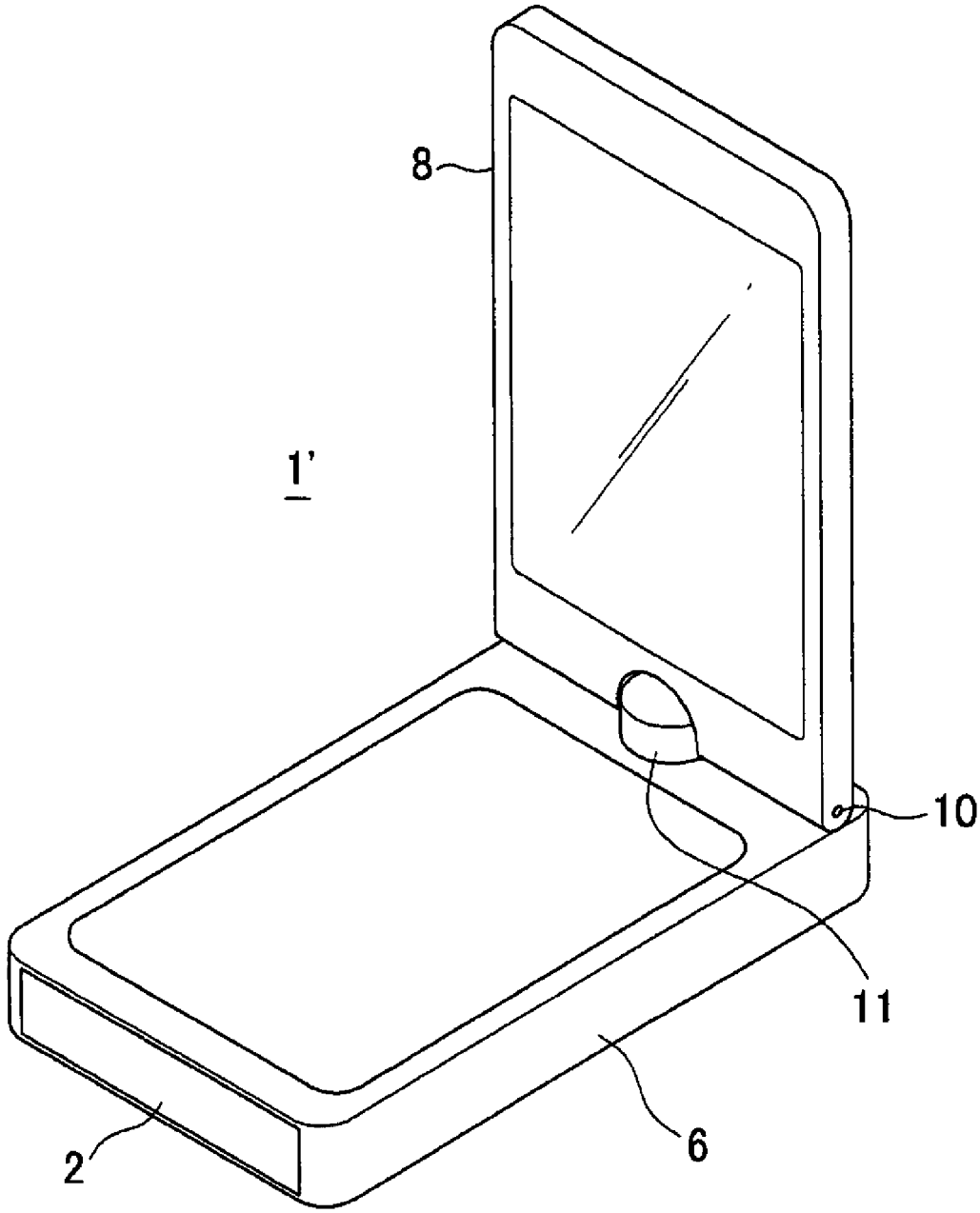
FIG. 5 is a perspective view of a drawer-like cosmetic case according to another exemplary embodiment of the present invention.

The present invention is not limited thereto, but it may be applied for the various cosmetic cases if the cosmetic cases have a drawer-like inner case. For example, as shown in FIG. 5, another cosmetic case 1' may have the mirror supporting plate 10 folded upward and downward on the outer case 6 and rotated in a range of 360 degree based on a folding shaft 11.

Figure 6:
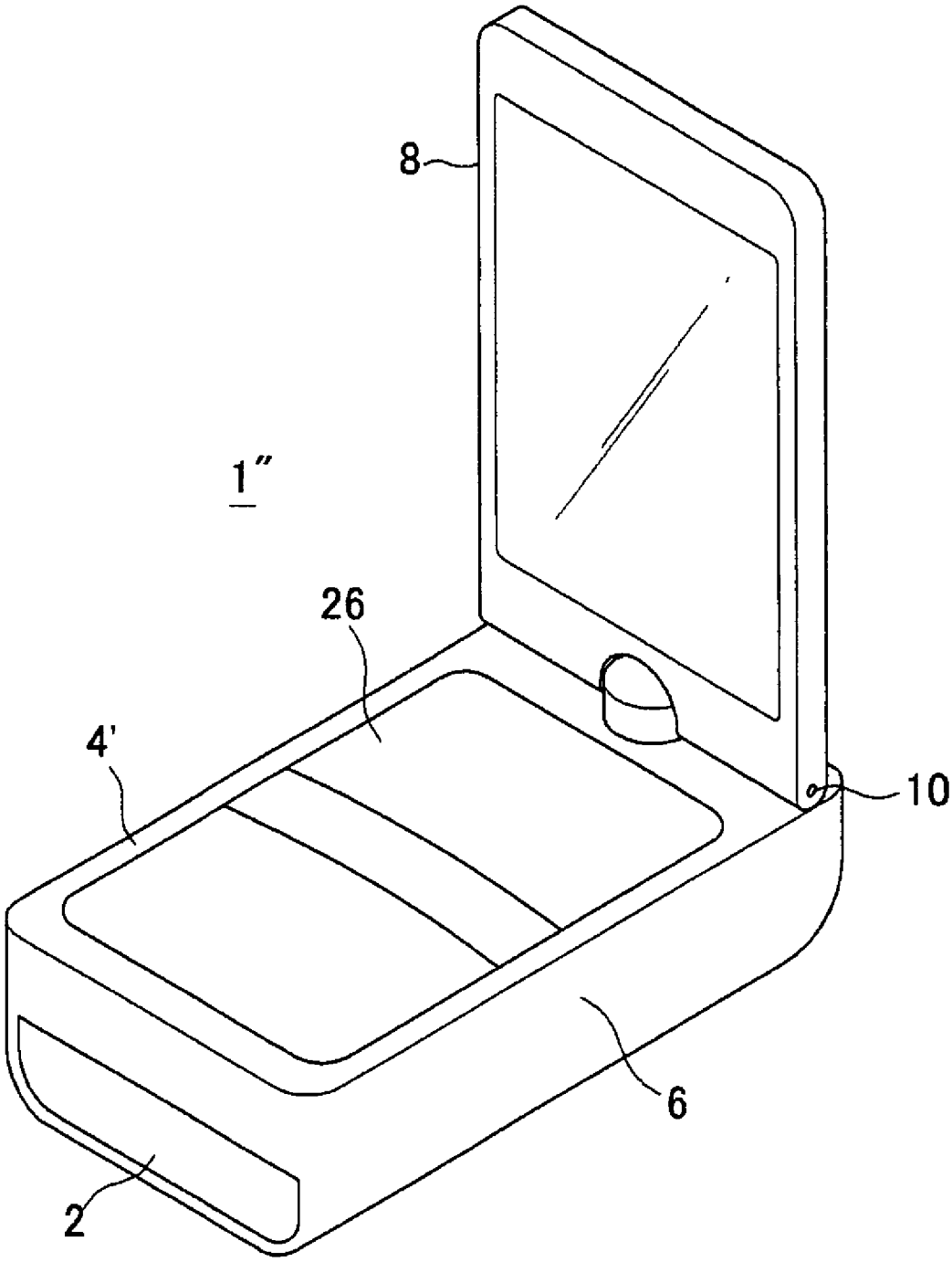
FIG. 6 is a perspective view of a drawer-like cosmetic case according to another exemplary embodiment of the present invention.
Figure 7:
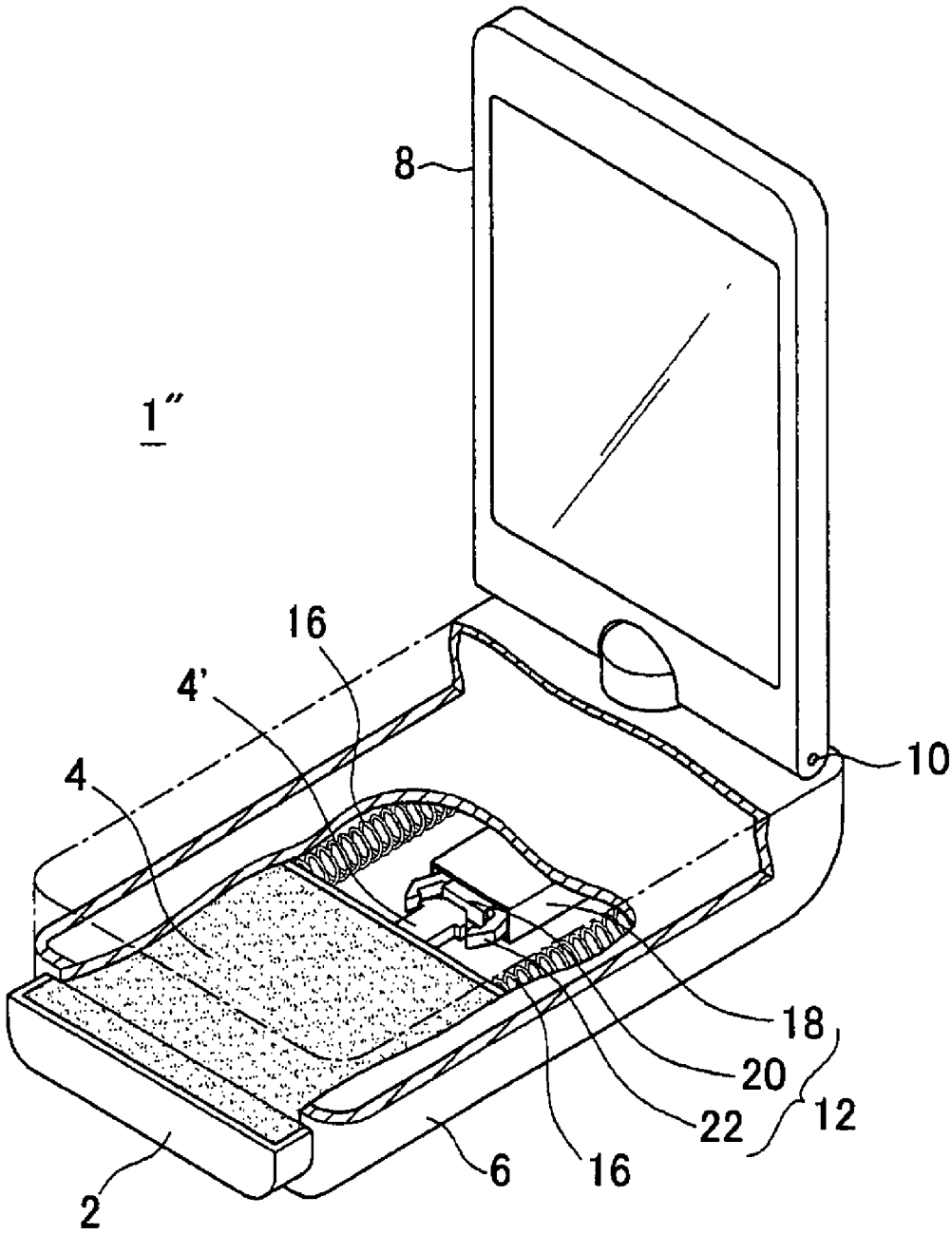
FIG. 7 is a perspective view of a drawer-like cosmetic case in which an upper part of a drawer-like cosmetic case of FIG. 6 is partly cut so as to show an internal structure thereof.

In addition, the present invention may be applied for another cosmetic case 1" as shown in FIG. 6 and FIG. 7.

FIG. 6 is a perspective view of a drawer-like cosmetic case according to another exemplary embodiment of the present invention. FIG. 7 is a perspective view of a drawer-like cosmetic case in which an upper part of a drawer-like cosmetic case of FIG. 6 is partly cut so as to show an internal structure thereof.

Another exemplary embodiment shown in the FIG. 6 and FIG. 7 is the same as the exemplary embodiment shown in the FIG. 1 to FIG. 4 except that another space 4' is provided on the drawer-like inner case 2.

As shown in FIG. 7, the space 4' may put makeup preparations such as a puff.

As described above, according to an exemplary embodiment of the present invention, the cosmetic case may have an outer case and an drawer-like inner case drawn in and drawn out the outer case capable of being automatically drawn in and out the outer case by means of an operation of the push-pull locking device when the user lightly pushes the drawer-like inner case in a drawn-in direction. Thus, it is convenient to carry the cosmetic case and it is prevented from a leakage of the cosmetic contents.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A drawer-like cosmetic case comprising an outer case and a drawer-like inner case drawn in or drawn out the outer case, the drawer-like inner case having at least one space for putting cosmetic contents wherein the outer case has a push-pull locking device and a pair of springs for pressing the drawer-like inner case in a drawn-out direction therein and the drawer-like inner case has a hooking member outside thereof such that the hooking member is cooperated with the push-pull locking device, wherein the push-pull locking device includes a guide member, a sliding member moved in a longitudinal direction in the guide member, and a pair of gripping members mounted on the sliding member, the guide member includes a drawn-in path having an inside one-directional projection formed thereon and a drawn-out path having an outside one-directional projection formed thereon, the sliding member has a triggering pin circulated along the drawn-in path and the drawn-out path at a bottom portion thereof, and the pair of gripping members is rotationally mounted on the sliding member such that they are closed when they are in contact with the inside of the guide member.

2. The cosmetic case of claim 1, further comprising a mirror supporting plate rotationally supported based on a folding shaft on the outer case.

3. The cosmetic case of claim 1, wherein the spring is disposed at both sides of the hooking member between the drawer-like inner case and the outer case.

4. The cosmetic case of claim 1, wherein the drawn-out path has a drawn-out groove adjacent to the inside one-directional projection and the drawn-in path has a drawn-in groove adjacent to the outside one-directional projection.

5. The cosmetic case of claim 1, wherein the sliding member has a stopping sheet at both sides thereof such that the stopping sheet presses a spring disposed in the guide member.

6. The cosmetic case of claim 5, wherein the guide member has a guide slot on a bottom portion thereof and the sliding member has a guide pin introduced in the guide slot.

7. A cosmetic case comprising an outer case and a drawer-like inner case drawn in or drawn out the outer case, the drawer-like inner case having a space for accommodating cosmetics wherein the outer case has a push-pull locking device therein and the drawer-like inner case has a hooking member outside thereof such that the push-pull locking device is cooperated with the hooking member and the outer case further has a spring therein such that the spring presses the drawer-like inner case in a drawn-out direction, and the push-pull locking device includes a guide member, a sliding member moved in a longitudinal direction in the guide member, and a pair of gripping members mounted on the sliding member, the guide member includes a drawn-in path having an inside one-directional projection formed thereon and a drawn-out path having an outside one-directional projection formed thereon, the sliding member has a triggering pin circulated along the drawn-in path and the drawn-out path at a bottom portion thereof, and the pair of gripping members is rotationally mounted on the sliding member such that they are closed when they are in contact with the inside of the guide member.

* * * * *